United States Patent [19]

Witt

[11] 4,445,346

[45] May 1, 1984

[54] APPARATUS FOR WET PROCESSING TEXTILE MATERIAL IN ENDLESS ROPE FORM

[75] Inventor: Fritz K. Witt, Charlotte, N.C.

[73] Assignee: Keiltex Corporation, Charlotte, N.C.

[21] Appl. No.: 464,562

[22] Filed: Feb. 7, 1983

[51] Int. Cl.³ ..... D06B 3/26; D06B 3/28

[52] U.S. Cl. ..... 68/178

[58] Field of Search ..... 68/177, 178

[56] References Cited

U.S. PATENT DOCUMENTS

| | | | |
|---|---|---|---|
| 1,246,993 | 11/1917 | Payet | 68/177 X |
| 1,766,716 | 6/1930 | McConnell | 68/178 X |
| 2,978,291 | 4/1961 | Fahringer | 68/177 X |
| 3,511,068 | 5/1970 | Fujii | 68/177 |
| 3,599,447 | 8/1971 | Arashi | 68/177 |
| 3,685,325 | 8/1972 | Carpenter | 68/177 |
| 3,696,645 | 10/1972 | Henningsen et al. | 68/177 |
| 3,780,544 | 12/1973 | Turner et al. | 68/177 |
| 3,894,412 | 7/1975 | Fleissner | 68/177 X |
| 3,921,420 | 11/1975 | Aurich et al. | 68/178 X |
| 3,949,575 | 4/1976 | Turner et al. | 68/178 X |
| 3,950,968 | 4/1976 | Dalla Vecchia | 68/178 X |
| 4,007,517 | 2/1977 | Turner et al. | 68/177 X |
| 4,023,385 | 5/1977 | Hurd | 68/178 X |
| 4,036,038 | 7/1977 | Aurich et al. | 68/178 X |
| 4,114,407 | 9/1978 | Turner et al. | 68/178 |
| 4,129,017 | 12/1978 | Greer | 68/177 X |
| 4,360,937 | 11/1982 | Putnam | 68/178 X |

FOREIGN PATENT DOCUMENTS 2073797 10/1981 United Kingdom ..... 68/178

*Primary Examiner*—Philip R. Coe

*Attorney, Agent, or Firm*—Bell, Seltzer, Park and Gibson

[57] ABSTRACT

An apparatus is provided for wet processing, preferably jet dyeing, textile material in endless rope form in an enclosed compact vessel by circulating the rope of material through a rope transport tube under the influence of a Venturi-induced jet of processing liquid and then collecting the material in the bottom of the vessel in an accumulator section at least partially submerged in the treatment liquid for recirculation through the transport tube by the jet of processing liquid. The apparatus is characterized by an accumulator section having a length at least one-half of the inside peripheral cross-sectional dimension of the vessel about a horizontal axis and a rope transport tube having a length of at least two-thirds of the inside peripheral cross-section dimension of the vessel about the horizontal axis and preferably positioned in the lower portion of the vessel to extend at least around the outside of the accumulator section and between the accumulator section and an inside wall of the vessel. Whereby, an endless path of travel for the rope of material is provided completely within the compact vessel which is longer than the inside peripheral cross-sectional dimension of the vessel allowing travel of the rope of material through the transport section to be maximized to in turn maximize treatment of the rope of material by the turbulent flow of processing liquid within the transport tube.

7 Claims, 5 Drawing Figures

APPARATUS FOR WET PROCESSING TEXTILE MATERIAL IN ENDLESS ROPE FORM

FIELD OF THE INVENTION

This invention relates to an improved design of an apparatus for wet processing, preferably jet dyeing, textile material in endless rope form in an enclosed vessel by circulating the rope of material through a rope transport tube under the influence of a Venturi-induced jet of processing liquid and then collecting the material in the bottom of the vessel in an accumulator section at least partially submerged in the treatment liquid for recirculation through the transport tube by the jet of processing liquid.

BACKGROUND OF THE INVENTION

Of this type of apparatus, jet dyeing machines were introduced in the 1960's to provide the processors of polyester fabric with the means of controlling repeatability in economical conditions. The benefits that were derived which could not be specifically measured were better bulking, uniform dyeing, fewer adds and reduced handling of the fabric. The immediate results with the use of these machines for dyeing textile fabrics were shorter dye cycles, reduced chemical consumption, almost complete dye exhaustion, and less utilities per pound of fabric processed.

While this type of apparatus is utilized primarily for dyeing of textile fabrics, it may also be utilized for other wet processing operations, such as washing, scouring, etc. Specific examples of the construction and operation of machines of this type may be seen in U.S. Pat. Nos. 2,978,291; 3,685,325; 3,780,544; 3,949,575; 4,007,517; 4,023,385; 4,036,038; 4,114,407; 4,129,017 and 4,360,937.

These patented machines, because they process textile material in endless rope form traveling in an endless path about a horizontal axis of the machine within a predetermined compact space, are also advantageous in that they perform the dyeing or the wet processing operation in a pressurized vessel which occupies a minimum amount of space and therefore minimizes the area required in the manufacturing facility for containing the machine. Because of this, these machines have come to be known as "compact" machines or "compact" jet dyeing machines.

In addition to the above described specific machines, this type of apparatus includes machines which dye and otherwise wet process textile material in endless rope form utilizing the same general devices and techniques discussed above, except that the vessel utilized is an atmospheric vessel and not a pressurized vessel, since the dyeing or wet processing is not required to be performed under pressure. An example of such a machine is manufactured and sold by MCS s.p.a., 24059 Urgnano, Bergamo, Italy under the tradename Mulinello Overflow MO serie 79, which is described as being particularly suitable for wet processing of terry cloth, velvet, velveteen, woollen, cotton, acrylic and polyamid articles.

In all of the machines of this type of apparatus, the dyeing or other wet processing treatment are by-in-large performed in the rope transport tube by the action of the jet propelling the dye liquid or other processing liquid directly onto the rope of textile material as it is transported through such tube promoting an active exchange of dyestuff or other materials from the processing liquid into the textile material. This is particularly true since the speed of travel of the processing liquid and the speed of travel of the rope of textile material through the transport tube is different and the speed of travel of the processing liquid is faster causing a turbulent contact of the processing liquid on the rope of textile material.

Inasmuch as the endless rope of textile material travels in an endless path within the vessel of the machine about a horizontal axis through the machine, the length of the transport tube has usually been necessarily limited by the inside peripheral cross-sectional dimension of the vessel about the horizontal axis. However, to overcome this problem and to provide a longer rope transport tube, some manufacturers of thse machines have constructed rope transport tubes which extend from within the machine vessel, outside the machine vessel through a superstructure, and back into the machine vessel. However, problems have been presented with this type of construction with the complexity of the construction of the transport tube and associated superstructure positioned outside the machine vessel, including heat loss, insulation problems, etc.

In order to accomodate a longer rope transport tube, a jet dyeing machine has been proposed utilizing a long auto-clave type vessel, in which the cloth transport tube is positioned along the length of such vessel. This type of machine is also sold by MCS under the tradename SILURO Jet JR serie 90. However, the size of the autoclave type vessel presents problems, among others, of space within manufacturing facilities in that it requires much more space than the prior "compact" jet dyeing machines.

OBJECTS AND SUMMARY OF THE INVENTION

Accordingly, it is the object of this invention to provide an improved design of an apparatus for wet processing, particularly jet dyeing, textile material which overcomes problems presented by the above discussed prior machines by providing a longer rope transport tube directly within the machine vessel to obtain the advantages thereof, while eliminating any transport tube superstructure and while retaining the compact machine vessel.

By this invention it has been found that the above object may be accomplished by providing specifically an improved design of an apparatus for wet processing textile material in endless rope form and traveling in an endless path about a horizontal axis within a predetermined compact space and including the following mechanisms.

A compact vessel contains the treating bath of processing liquid in a lower portion thereof and has a predetermined inside peripheral cross-sectional length about the horizontal axis. An elongate accumulator section is positioned within a lower portion of the vessel for receiving, accumulating and passing portions of the rope of material therethrough and through the treating bath about the horizonal axis. The accumulator section has a length at least one half of the inside peripheral dimension of the vessel. A rope transport tube is positioned entirely within the vessel for receiving at an entrance end thereof the rope of material from one end of the accumulator section and for passing the rope of material therethrough about the horizontal axis and for discharging the rope of material at an exit end thereof into the other end of the accumulator section. The transport tube has a length at least two-thirds of the inside peripheral dimension of the vessel and, preferably, extends at least around the outside of the accumulator section in the lower portion of the vessel and between the accumulator section and an inside wall of the vessel. A jet is positioned generally at the entrance end of the transport tube for creating a turbulent flow of processing liquid through the transport tube for carrying the rope of material therethrough and for treating the rope of material with the processing liquid under turbulent conditions.

With this improved construction, an endless path of travel for the rope of material is provided completely within the compact vessel which is longer than the inside peripheral dimension of the vessel allowing the travel of the rope material through the transport tube to be maximized to in turn maximize treatment of the rope of material by the turbulent flow of processing liquid within the transport tube, while eliminating the problems presented by prior machines in avoiding the use of transport tube superstructures outside of the vessel or the use of long auto-clave vessels.

BRIEF DESCRIPTION OF THE DRAWINGS

Some of the objects and advantages of this invention having been stated above, other objects and advantages will appear in the following description when taken in conjunction with the accompanying drawings, in which.

DETAILED DESCRIPTION OF THE INVENTION

Figure 1:
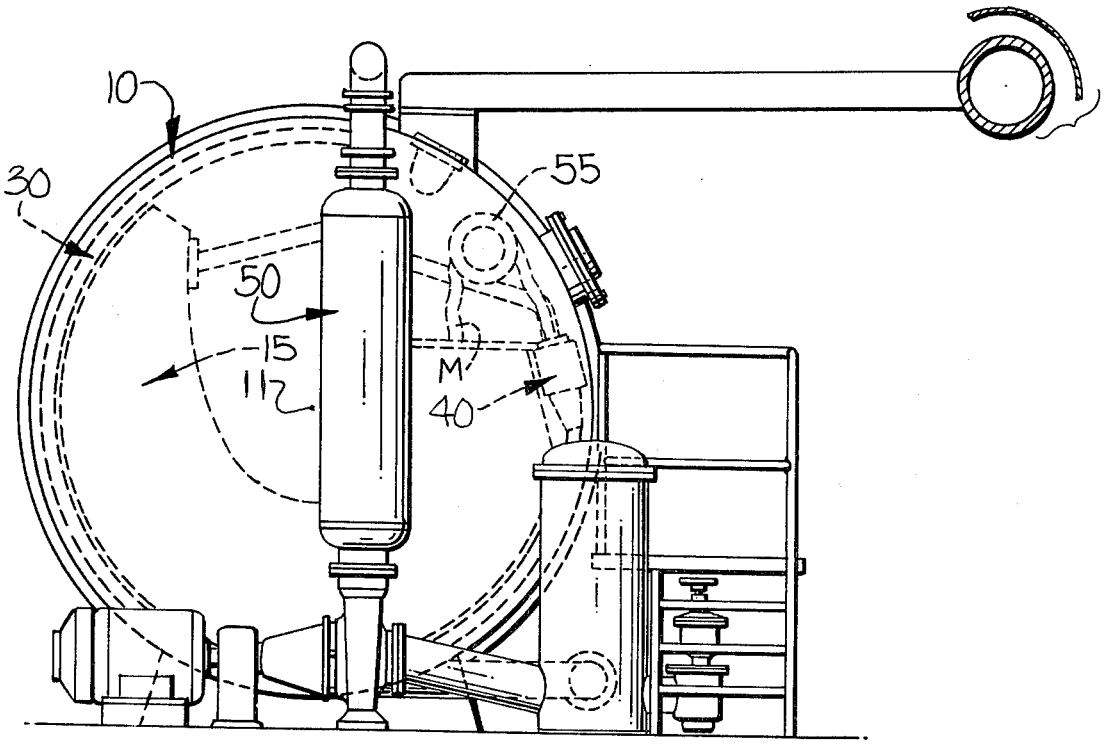
FIG. 1 is a side elevational view of an apparatus constructed in accordance with this invention.

Referring now to the drawings, there is illustrated therein an improved apparatus for wet processing textile material M utilizing the novel features of this invention in the form of a compact jet dyeing machine which will be described hereinafter. However, it is to be understood that the novel features of this invention may also be utilized in other machines for wet processing textile material.

Figure 3:
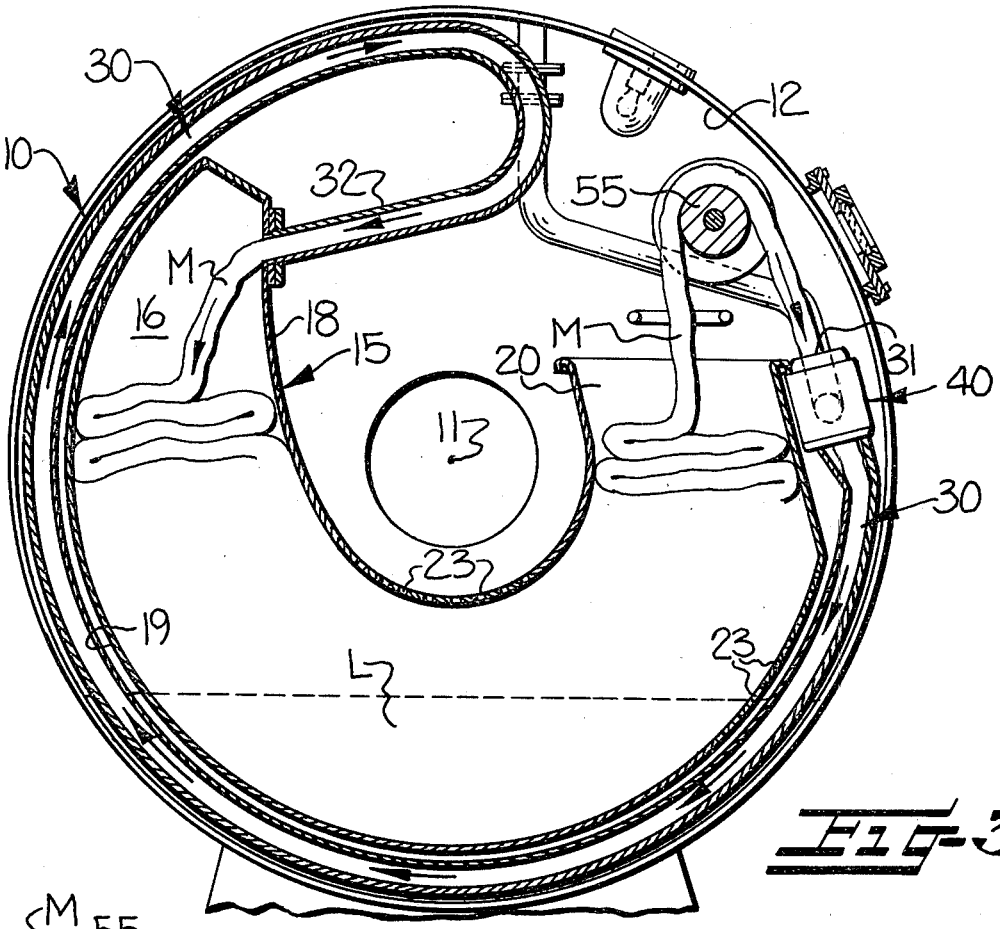
FIG. 3 is a cross-sectional view, taken generally along the line 3—3, of FIG. 2.

The jet dyeing machine illustrated in the drawings includes a generally cylindrical, pressurized, compact vessel 10 which is constructed for dyeing two separate endless ropes of textile material traveling in endless paths about a horizontal axis 11, as shown in FIG. 3, within a predetermined compact space. It is to be understood that the vessel 10 could process a single endless rope of textile material M or more than 2 endless ropes of textile material M, as desired. However, regardless of the number of endless ropes of textile material M being processed, the compact space for processing each of the endless ropes of textile material M within the vessel 10 is defined within a predetermined inside peripheral cross-sectional dimension about the horizontal axis 11 which would be the inside peripheral dimension of the inside wall 12 of the vessel 10 about or around the horizontal axis 11 and taken on a cross-section, as shown in FIG. 3.

It is to be understood that while the vessel 10 is preferably a generally cylindrical, pressurized vessel which has a predetermined inside peripheral cross-sectional circular dimension about the horizontal axis 11, it may also be in the form of a nonpressurized, atmospheric vessel and may take other shapes than cylindrical having other shapes of the inside peripheral cross-sectional dimension about the horizontal axis 11. Notwithstanding, in all cases, the compact space within the interior of the vessel 10 in which the endless rope of textile material M is processed will be defined by a predetermined inside peripheral cross-sectional dimension of the interior wall 12 of the vessel 10 about the horizontal axis 11. The compact vessel 10 contains a treating bath of dye liquid L in a lower portion thereof for purposes to be described more fully hereinafter.

An elongate, preferably generally arcuate, accumulator section 15 is positioned within the vessel at the lower portion thereof and is defined by side walls 16, 17, upper wall 18 and bottom wall 19 with one open end 20 and another open end 21. The top and bottom walls 18, 19 of the accumulator section 15 include perforations 23 for allowing the bath of dye liquid L in the lower portion of the vessel 10 to pass into the interior of the accumulator section 15, as shown in FIG. 3. The accumulator section 15 receives, accumulates and passes portions of the endless rope of textile material M therethrough and through the treating bath of dye liquid L about the horizontal axis 11, as shown in FIG. 3. The accumulator section 15, as may be clearly seen in FIG. 3, has a length, preferably arcuate, at least one-half of the inside peripheral dimension of the vessel 10.

The jet dyeing machine further includes an elongate, preferably generally arcuate, rope transport tube 30 positioned entirely within the vessel 10 for receiving at an entrance end 31 thereof the rope of textile material M from the one end 20 of the accumulator section 15 and for passing the rope of textile material M therethrough about the horizontal axis 11 and for discharging the rope of textile material M at an exit end 32 into the other end 21 of the accumulator section 15. The rope transport tube 30 preferably extends at least around the outside of the accumulator section 15 in the lower portion of the vessel 10 and between the accumulator section 15 and the inside wall 12 of the vessel 10. The rope transport tube 30 has a length of at least two-thirds of the inside peripheral dimension of the vessel 10. While the length of the rope transport tube 30 is preferably arcuate when contained within a cylindrical vessel 10 having a circular peripheral cross-sectional dimension about the horizontal axis 11, it is conceivable that the rope transport tube 30 could take other shapes if the vessel 10 takes other shapes. However, the rope transport tube 30 should have a length of at least two-thirds of the inside peripheral cross-sectional dimension of the vessel 10 about the horizontal axis 11, regardless of such shapes.

The jet dyeing machine further includes a jet device 40 preferably of the Venturi-type positioned generally at the entrance end 31 of the transport tube 30 for creating a turbulent flow of dye liquid L through the transport tube for carrying the rope of material M therethrough and for treating the rope of material with the dye or processing liquid under turbulent conditions.

Figure 2:
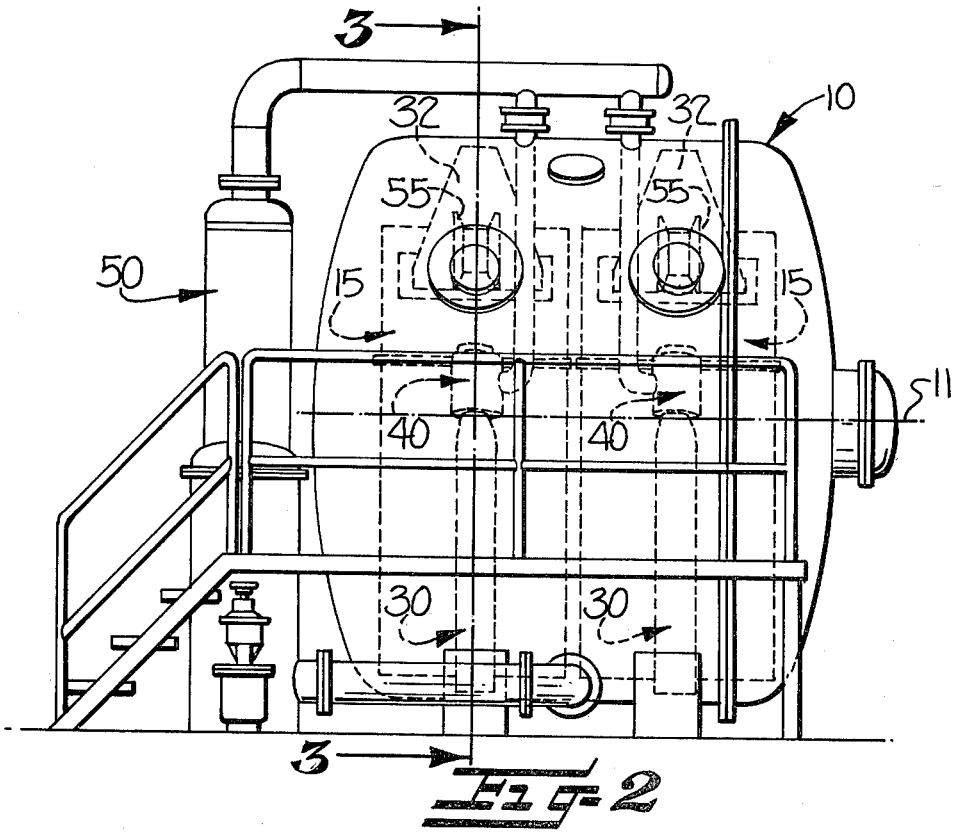
FIG. 2 is a front elevational view of the apparatus of FIG. 1.

This operation of the jet 40 in a jet dyeing machine is well understood by those with ordinary skill in the art and complete details of the construction and operation are not believed to be necessary herein. However, as illustrated in FIGS. 1 and 2, a dye liquid recirculation system 50 in generally illustrated for providing dye liquid L to the jet 40 and for recirculating the dye liquid L from the bath in the lower portion of the vessel 10. Full details of the construction and operation of this dye liquid recirculation system are not believed necessary herein.

As is well known to those with ordinary skill in the art, the dyeing or other treatment of the rope of textile material M in this type of apparatus is by-in-large performed in the rope transport tube 30 by the action of the jet 40 propelling the dye or processing liquid L directly onto the rope of textile material M as it is transported through the rope transport tube 30. Because the jet 40 creates a velocity for the dye or processing liquid L which is greater than the speed of travel of the rope of textile material M through the cloth transport tube L, a turbulent flow of the dye or processing liquid L is created causing a turbulent contact of the dye or processing liquid on the rope of material M inducing an active exchange of the dyestuff or other materials in the dye or processing liquid L onto the rope of textile material M.

Heretofore, these rope transport tubes 30 have, for the most part, been round tubes which tend to create a vortex within the tube resulting in entanglement of the endless rope of textile material M being circulated through the rope transport tube 30. Accordingly, the rope transport tube 30 is preferably constructed with a rectangular cross-sectional shape, as shown in the drawings, which eliminates such vortex and reduces or eliminates entanglement of the endless rope of textile material M.

Figure 4:
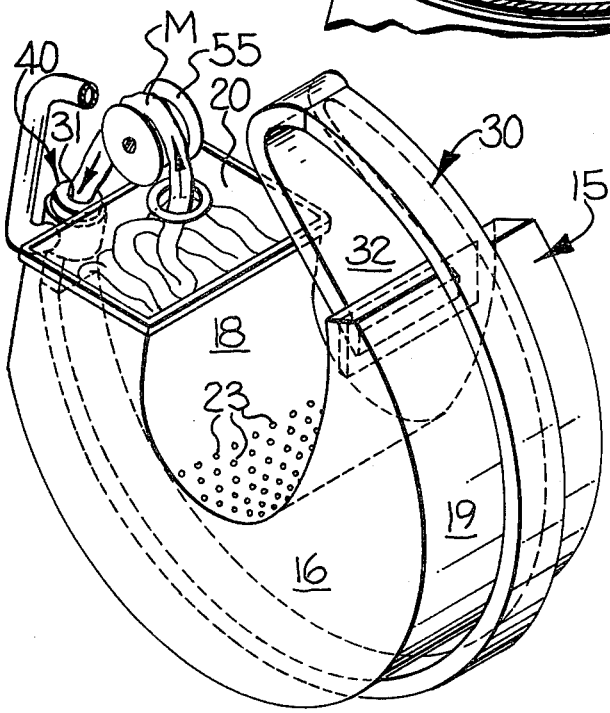
FIG. 4 is a perspective view, from one side thereof, of the rope transport tube and accumulator section, removed from the vessel of the apparatus FIGS. 1-3.
Figure 5:
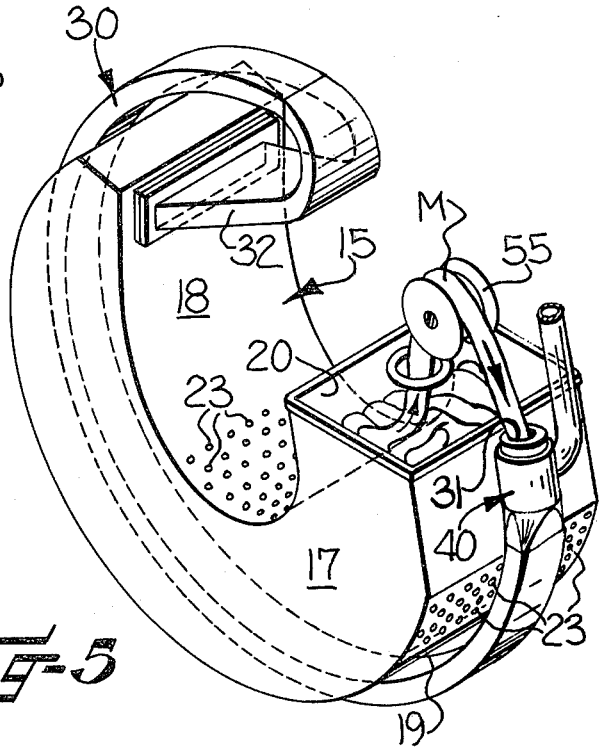
FIG. 5 is a perspective view of the devices shown in FIG. 4 and taken from the other side thereof.

Due to the velocity of the flow of dye or processing liquid L through the rope transport tube 30, problems of entanglement of the rope of textile material M at the exit end 32 of the transport tube 30 and the entrance or other end 21 of the accumulator section 15 have occurred. To overcome this problem of entanglement at this location, the exit end 32 of the rope transport tube 30 has been constructed of an expanded cross-sectional area and generally funnel-shaped, as shown particularly in FIGS. 4 and 5. This reduces the velocity of the flow of dye liquid L at the exit end 30 and thus reduces entanglement of the rope of textile material M as it enters the accumulator section 15.

The remaining constructional features of the compact jet dyeing machine illustrated in the drawings are common to most jet dyeing machines and are well understood by those with ordinary skill in the art and need not be described herein for a full understanding of this invention.

With a jet dyeing machine constructed as described above, the rope of textile material M is introduced into the rope transport tube 30 at the entrance end 31 thereof and is caused to flow through the rope transport tube 30 by the Venturi-jet induced flow of dye liquid L. The rope of textile material M passes through such rope transport tube 30 along a path which has a length at least two-thirds of the inside peripheral cross-sectional dimension of the vessel 10 about the horizontal axis 11. The direction of travel of the rope of material M, which is initially downwardly and around the outside of the accumulator section 15 is advantageous over previous rope transport tubes, which were usually positioned in the upper portion of the vessel 10, since travel of the rope of material M through such rope transport tube 30 will gain the advantage of gravity flow in at least the initial travel through the rope transport tube 30. Thus, the rope transport tube 30 is preferably positioned around the accumulator section in the lower portion of the vessel 10 in accordance with this invention. The rope of material M further travels through the rope transport tube 30, which wraps entirely around the accumulator section 15, and enters the accumulator section 15 at the other end 21 thereof to accumulate in folds within the accumulator section 15, in a manner well understood by those with ordinary skill in the art. The rope of material M then passes through the accumulator section 15 and through the bath of dye liquid L in at least a lower portion of such accumulator section 15 to receive further dyeing or treatment in the accumulator section 15. The rope of material M then exits the accumulator section 15 at the one end 20 thereof and over a roller 55 to again enter the rope transport tube 30 through the jet 40 for recirculation. The roller 55 in the jet dyeing machine constructed in accordance with this invention need not be driven, as most prior rollers have been, due to the path of travel of the rope of material M through the rope transport tube 30 being disposed at least around the lower portion of the vessel 10 and around the outside of the accumulator section 15. This allows a more gentle handling of the rope of material M being processed.

In accordance with this invention, an endless path of travel for the rope of material M is provided completely within the compact vessel 10, eliminating the need of a superstructure as has been heretofore proposed, which is longer than the inside peripheral cross-sectional dimension of the vessel 10 allowing the travel of the rope of material M through the transport tube 30 to be maximized to in turn maximize treatment of the rope of material M by the turbulent flow of dye liquid L within the transport tube 30 to obtain advantages of a long transport tube while maintaining a compact vessel 10, without the necessity to utilize the previously proposed larger auto-clave type vessel which presents space problems within the manufacturing facility.

In the drawings and specifications, there has been set forth a preferred embodiment of the invention and although specific terms are employed, they are used in a generic and descriptive sense only and not for purposes of limitation.

What is claimed is:

1. An improved apparatus for wet processing textile material in endless rope form and traveling in an endless path about a horizontal axis within a predetermined compact space comprising:

a compact vessel for containing a treating bath of processing liquid in a lower portion thereof and having a predetermined inside peripheral cross-sectional dimension about the horizontal axis;

an elongate accumulator section within said vessel in said lower portion thereof for receiving, accumulating and passing portions of the rope of material therethrough and through the treating bath about the horizontal axis, said accumulator section having a length at least one half of the inside peripheral dimension of said vessel;

a rope transport tube within said vessel for receiving at an entrance end thereof the rope of material from one end of said accumulator section and for passing the rope of material therethrough about the horizontal axis and for discharging the rope of material at an exit end thereof into the other end of said accumulator section, said transport tube having a length of at least two-thirds of the inside peripheral dimension of said vessel; and jet means positioned generally at said entrance end of said transport tube for creating a turbulent flow of processing liquid through said transport tube for carrying the rope of material therethrough and for treating the rope of material with the processing liquid under turbulent conditions;

whereby, an endless path of travel for the rope of material is provided completely within said compact vessel which is longer than the inside peripheral cross-sectional dimension of said vessel allowing the travel of the rope of material through said transport tube to be maximized to in turn maximize treatment of the rope of material by the turbulent flow of processing liquid within said transport tube.

2. An improved apparatus for wet processing textile material in endless rope form and traveling in an endless path about a horizontal axis within a predetermined compact space comprising:

a compact vessel for containing a treating bath of processing liquid in a lower portion thereof and having a predetermined inside peripheral cross-sectional dimension about the horizontal axis;

an elongate accumulator section within said vessel in said lower portion thereof for receiving, accumulating and passing portions of the rope of material therethrough and through the treating bath about the horizontal axis, said accumulator section having a length at least one half of the inside peripheral dimension of said vessel;

a rope transport tube within said vessel for receiving at an entrance end thereof the rope of material from one end of said accumulator section and for passing the rope of material therethrough about the horizontal axis and for discharging the rope of material at an exit end thereof into the other end of said accumulator section, said transport tube having a length of at least two-thirds of the inside peripheral dimension of said vessel and extending at least around the outside of said accumulator section in the lower portion of said vessel and between said accumulator section and an inside wall of said vessel; and jet means positioned generally at said entrance end of said transport tube for creating a turbulent flow of processing liquid through said transport tube for carrying the rope of material therethrough and for treating the rope of material with the processing liquid under turbulent conditions;

whereby, an endless path of travel for the rope of material is provided completely within said compact vessel which is longer than the inside peripheral cross-sectional dimension of said vessel allowing the travel of the rope of material through said transport tube to be maximized to in turn maximize treatment of the rope of material by the turbulent flow of processing liquid within said transport tube.

3. An improved apparatus for jet dyeing textile material in endless rope form and traveling in an endless path about a horizontal axis within a predetermined compact space comprising:

a generally cylindrical, pressurized, compact vessel for containing a treating bath of dye liquid in a lower portion thereof and having a predetermined inside peripheral cross-sectional circular dimension about the horizontal axis;

an elongate, generally arcuate, accumulator section within said vessel in said lower portion thereof for receiving, accumulating and passing portions of the rope of material therethrough and through the dye bath about the horizontal axis, said accumulator section having an arcuate length at least one half of the inside peripheral circular dimension of said vessel;

a generally arcuate, rope transport tube within said vessel for receiving at an entrance end thereof the rope of material from one end of said accumulator section and for passing the rope of material therethrough about the horizontal axis and for discharging the rope of material at an exit end thereof into the other end of said accumulator section, said transport tube having an arcuate length of at least two-thirds of the inside peripheral circular dimension of said vessel; and jet means positioned generally at said entrance end of said transport tube for creating a turbulent flow of dye liquid through said transport tube for carrying the rope of material therethrough and for treating the rope of material with the dye liquid under turbulent conditions;

whereby, an endless path of travel for the rope of material is provided completely within said compact vessel which is longer than the inside peripheral cross-sectional circular dimension of said vessel allowing the travel of the rope of material through said transport tube to be maximized to in turn maximize treatment of the rope of material by the turbulent flow of dye liquid within said transport tube.

4. In an apparatus, as set forth in claim 3, in which said transport tube extends at least around the outside of said accumulator section in the lower portion of said vessel and between said accumulator section and an inside wall of said vessel.

5. In an apparatus, as set forth in claim 1, 2 or 3, in which said transport tube has a rectangular cross-sectional shape.

6. In an apparatus, as set forth in claim 1, 2 or 3, in which said exit end of said transport tube is of expanded cross-sectional area and generally funnel-shaped for reducing the velocity of the jet of processing liquid at said exit end of said transport tube.

7. An improved apparatus for jet dyeing textile material in endless rope form and traveling in an endless path about a horizontal axis within a predetermined compact space comprising:

a generally cylindrical, pressurized, compact vessel for containing a treating bath of dye liquid in a lower portion thereof and having a predetermined inside peripheral cross-sectional circular dimension about the horizontal axis;

an elongate, generally arcuate, accumulator section within said vessel in said lower portion thereof for receiving, accumulating and passing portions of the rope of material therethrough and through the dye bath about the horizontal axis, said accumulator section having an arcuate length at least one half of the inside peripheral circular dimension of said vessel;

a generally arcuate, rope transport tube within said vessel for receiving at an entrance end thereof the rope of material from one end of said accumulator section and for passing the rope of material therethrough about the horizontal axis and for discharging the rope of material at an exit end thereof into the other end of said accumulator section, said transport tube extending at least around the outside of said accumulator section in the lower portion of said vessel and between said accumulator section and an inside wall of said vessel and having an arcuate length of at least two-thirds of the inside peripheral circular dimension of said vessel, said transport tube having a rectangular cross-sectional shape, and said exit end of said transport tube being of expanded cross-sectional area and generally funnel-shaped; and jet means positioned generally at said entrance end of said transport tube for creating a turbulent flow of dye liquid through said transport tube for carrying the rope of material therethrough and for treating the rope of material with the dye liquid under turbulent conditions;

whereby, an endless path of travel for the rope of material is provided completely within said compact vessel which is longer than the inside peripheral cross-sectional circular dimension of said vessel allowing the travel of the rope of material through said transport tube to be maximized to in turn maximize treatment of the rope of material by the turbulent flow of dye liquid within said transport tube.

* * * * *